US008997337B2

(12) United States Patent
Sone et al.

(10) Patent No.: US 8,997,337 B2
(45) Date of Patent: Apr. 7, 2015

(54) MANUFACTURING APPARATUS AND MANUFACTURING METHOD FOR AN ELECTRONIC COMPONENT

(75) Inventors: Shunsuke Sone, Kawasaki (JP); Hirokazu Yamanishi, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 389 days.

(21) Appl. No.: 12/882,255

(22) Filed: Sep. 15, 2010

(65) Prior Publication Data

US 2011/0061225 A1 Mar. 17, 2011

(30) Foreign Application Priority Data

Sep. 16, 2009 (JP) ..... 2009-214995

(51) Int. Cl.
*H01R 43/18* (2006.01)
*H01R 12/71* (2011.01)
*H01R 12/58* (2011.01)

(52) U.S. Cl.
CPC ..... *H01R 43/18* (2013.01); *H01R 12/716* (2013.01); *H01R 12/585* (2013.01)

(58) Field of Classification Search
CPC .... H01R 43/18; H01R 12/716; H01R 43/205; H01R 23/7073; H05K 13/0413; H05K 13/0404
USPC ..... 29/739–741, 747, 760–761, 845, 33 M; 439/79–83, 374, 381, 733, 751
See application file for complete search history.

(56) References Cited

U.S. PATENT DOCUMENTS

| | | | | |
|---|---|---|---|---|
| 3,545,606 | A * | 12/1970 | Lightner et al. | 206/716 |
| 5,421,943 | A * | 6/1995 | Tam et al. | 156/273.9 |
| 5,442,152 | A * | 8/1995 | Huang | 200/345 |
| 5,453,016 | A * | 9/1995 | Clark et al. | 439/79 |
| 5,509,192 | A | 4/1996 | Ota et al. | |
| 5,590,192 | A * | 12/1996 | Lovett et al. | 705/51 |
| 5,600,881 | A * | 2/1997 | Wanha | 29/741 |
| 5,732,459 | A * | 3/1998 | Shiraishi et al. | 29/603.06 |
| 6,561,829 | B2 * | 5/2003 | Maeda et al. | 439/247 |
| 6,609,295 | B1 * | 8/2003 | Koyama et al. | 29/832 |
| 6,835,074 | B2 * | 12/2004 | Sakata | 439/79 |

(Continued)

FOREIGN PATENT DOCUMENTS

| | | |
|---|---|---|
| JP | 4-107997 A | 4/1992 |
| JP | 6-163142 A | 6/1994 |
| JP | 6-283898 A | 10/1994 |

(Continued)

*Primary Examiner* — David Angwin
(74) *Attorney, Agent, or Firm* — Fujitsu Patent Center

(57) ABSTRACT

A manufacturing apparatus for an electronic component includes a plurality of press members provided with a pair of arm sections extending in one direction intersecting with a direction of the pressing, the plurality of press members contacting a housing of a connector and pressing a plurality of pins held by the housing toward a plurality of holes in a substrate, a drive unit pressing the press members and press-fitting the plurality of pins into the holes in the substrate, a stress measurement unit coupled with the pair of arm sections and adapted to measure a stress generated at the pair of arm sections when the pins are pressed toward the holes in the substrate, and a drive control unit controlling a press force of the drive unit in accordance with a measurement result of the stress measurement unit.

5 Claims, 15 Drawing Sheets

(56) References Cited

U.S. PATENT DOCUMENTS

| | | | | |
|---|---|---|---|---|
| 7,134,191 | B2 * | 11/2006 | Shioda | 29/760 |
| 7,299,541 | B2 * | 11/2007 | Ikeda et al. | 29/747 |
| 7,592,693 | B2 * | 9/2009 | Murphy | 257/686 |
| 7,722,366 | B2 * | 5/2010 | Yamamoto et al. | 439/79 |

FOREIGN PATENT DOCUMENTS

| | | | |
|---|---|---|---|
| JP | 8-293531 | A | 11/1996 |
| JP | 11-287632 | A | 10/1999 |
| JP | 2001-76836 | A | 3/2001 |
| JP | 2004-273214 | A | 9/2004 |

* cited by examiner

MANUFACTURING APPARATUS AND MANUFACTURING METHOD FOR AN ELECTRONIC COMPONENT

CROSS-REFERENCE TO RELATED APPLICATIONS

This application is based upon and claims the benefit of priority of the prior Japanese Patent Application No. 2009-214995, filed on Sep. 16, 2009, the entire contents of which are incorporated herein by reference.

FIELD

The embodiments discussed herein are related to a manufacturing apparatus and a manufacturing method for an electronic component.

BACKGROUND

A press-fit method is a method of pressing and mounting a connector arranged on a print substrate toward the print substrate by using a dedicated-use jig or press apparatus. The connector used in the press-fit method is referred to as a press-fit connector, a press-fitting connector, or the like.

As shown in FIG. 15A, a press-fit connector 50 is provided with a cross-sectionally U-shaped housing 52 having a plurality of contact pins 54 held by the housing 52 at a predetermined interval. The print substrate to which the press-fit connector 50 is mounted has through holes corresponding to the arrangement of the contact pins 54. According to the press-fit method, the connector is fixed by press-fitting and swaging sections of the contact pins 54 located on a lower side with respect to the housing 52 into the through holes of the print substrate.

Up to now, attachment of the connector was performed by using a press-fit jig 60 shown in FIG. 15B. The press-fit jig 60 has a main body part 62 essentially having a Π-shaped cross section and a plurality of members of press members 64 held by the main body part 62. Gaps 64*a* are formed in sections which are essentially a lower half of the respective press members 64. With the gaps 64*a*, a mechanical interference between the press-fit jig 60 and the contact pins 54 is prevented.

Incidentally, it is highly likely that the contact pins of the press-fit connector may be bent at the time of manufacturing or handing. the bent contact pins may not be properly inserted into the through holes. If such contact pins are further pressed, the contact pins may buckle, which could result in a mounting failure of the press-fit connector. In the case of a mounting failure, removal operation of the press-fit connector takes substantial time and man-hours.

Japanese Laid-open Patent Publication No. 11-287632, Japanese Laid-open Patent Publication No. 8-293531, and Japanese Laid-open Patent Publication No. 2001-76836 address the above-mentioned mounting failure caused by the bending of the pins.

However, according to Japanese Laid-open Patent Publication No. 11-287632 and Japanese Laid-open Patent Publication No. 8-293531, the pin bending which is caused by handling after a visual inspection cannot be detected. Japanese Laid-open Patent Publication No. 2001-76836 is a technology related to a failure determination after the end of the press-fit.

SUMMARY

According to an embodiment, a manufacturing apparatus for an electronic component includes a plurality of press members contacting a housing of a connector, pressing a plurality of pins held by the housing toward a plurality of holes in a substrate, and provided with a pair of arm sections extending in one direction intersecting with a direction of the pressing, a drive unit pressing the press members and press-fitting the plurality of pins into the holes in the substrate, a stress measurement unit provided to the respective arm sections and adapted to measure stress generated when the pins are pressed toward the holes in the substrate, and a drive control unit controlling a press force of the drive unit in accordance with a measurement result of the stress measurement unit.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

Figure 1A:
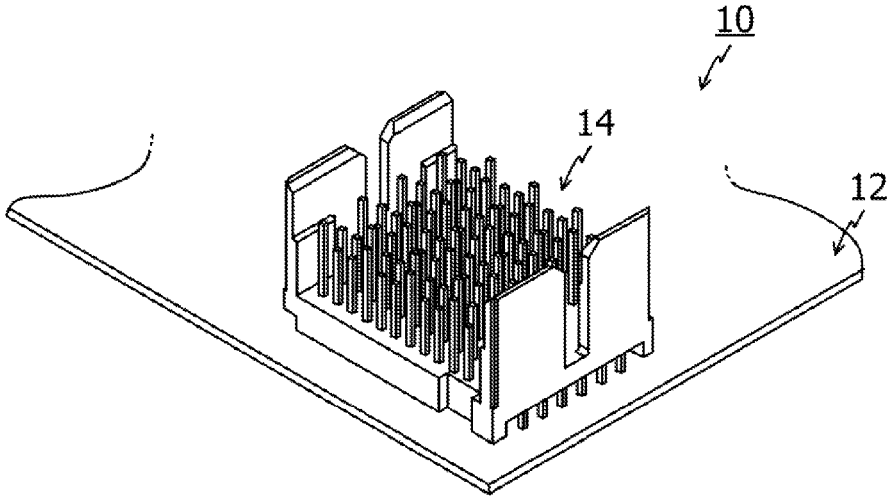
FIG. 1A shows a part of an electronic component.

FIG. 1A shows an electronic component manufactured according to the present embodiment. An electronic component 10 of FIG. 1A has a print substrate 12 and a connector 14 provided on the print substrate 12. It should be noted that FIG.

1 illustrates a state in which only one connector 14 is provided on the print substrate 12, but a connector other than the connector 14 or other components (such as LSI) can also be provided.

Figure 1B:
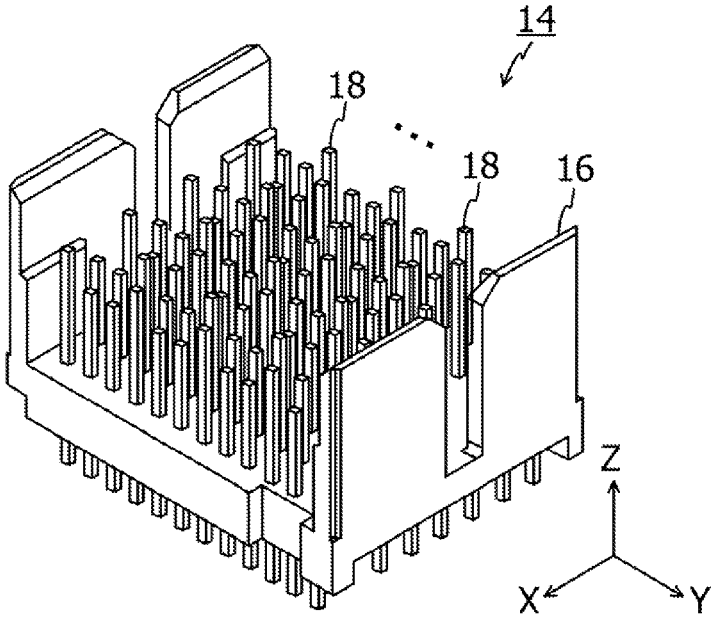
FIG. 1B shows a configuration of a connector.

FIG. 1B is a magnified view of the connector 14. As shown in FIG. 1B, the connector 14 is a so-called press-fit connector and has a housing 16 and a large number of contact pins 18 in a state of penetrating the housing 16. It should be noted that in FIG. 1B, a longitudinal direction of the contact pins 18 is set as a Z-axis direction, and directions in which the contact pins 18 are disposed are set as an X-axis direction and a Y-axis direction.

The housing 16 is made of resin or the like, and the housing 16 has a U-shaped cross section. In the housing 16, a large number of through holes for holding the contact pins 18 are formed. The contact pins 18 are pins made of phosphor bronze or beryllium copper, and a section located on the +Z side with respect to the housing 16 (a section to which a cable is connected) is applied with gold plating.

The contact pins 18 are pressed-in into through holes 12*a* (see FIG. 9) formed on the print substrate 12 with the same arrangement as the contact pins 18 for effecting the swaging. According to this, the connector 14 is fixed to the print substrate 12 (press-fit).

Figure 2:
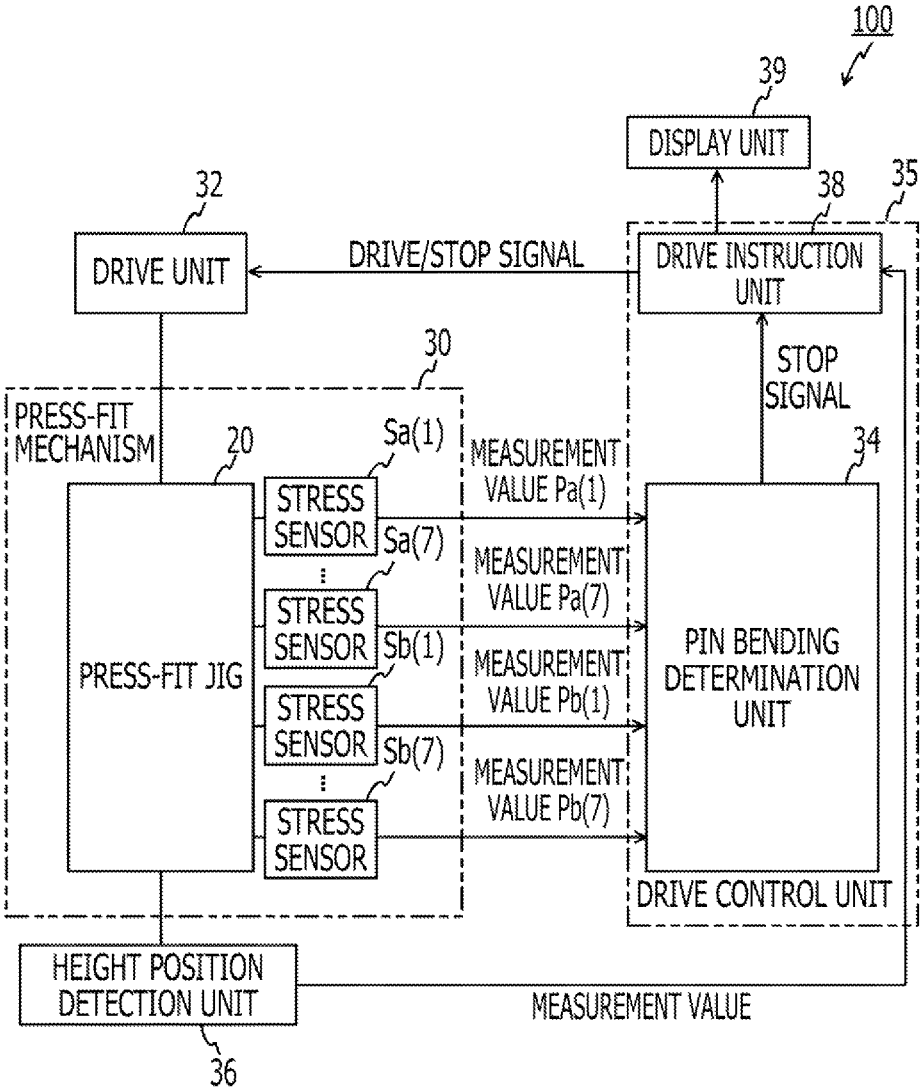
FIG. 2 is a block diagram of a manufacturing apparatus according to the present embodiment.

FIG. 2 is a block diagram of a manufacturing apparatus 100 for an electronic component which is used for fixing the connector 14 of FIG. 1 on the print substrate 12. As shown in FIG. 2, the manufacturing apparatus 100 is provided with a press-fit mechanism 30, a drive unit 32, a height position detection unit 36, a drive control unit 35, and a display unit 39. The drive control unit 35 includes a pin bending determination unit 34 and a drive instruction unit 38.

The press-fit mechanism 30 has a press-fit jig 20, 14 stress sensors Sa(1) to Sa(7) and Sb(1) to Sb(7) (hereinafter, while setting n=1 to 7, which will be described as "stress sensors Sa(n) and Sb(n)") functioning as a stress measurement unit.

Figure 3:
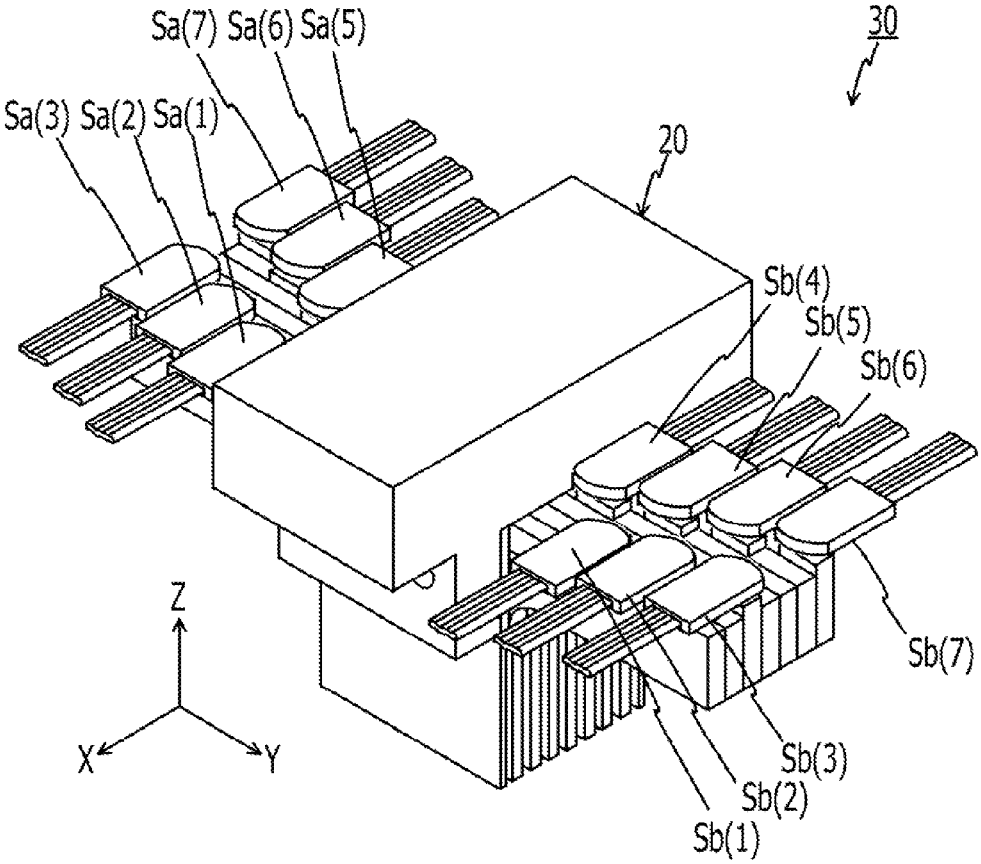
FIG. 3 shows a press-fit mechanism according to the present embodiment.
Figure 4:
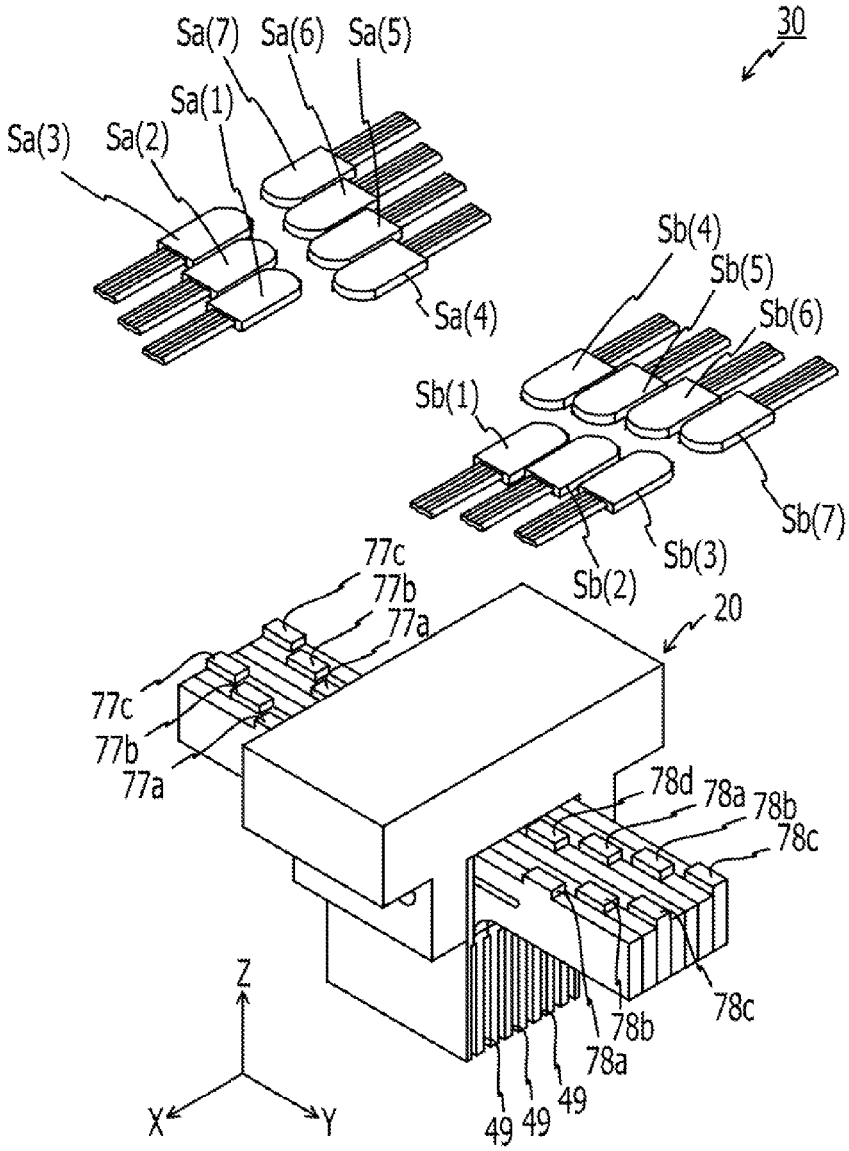
FIG. 4 is an exploded view of the press-fit mechanism according to the present embodiment.
Figure 5:
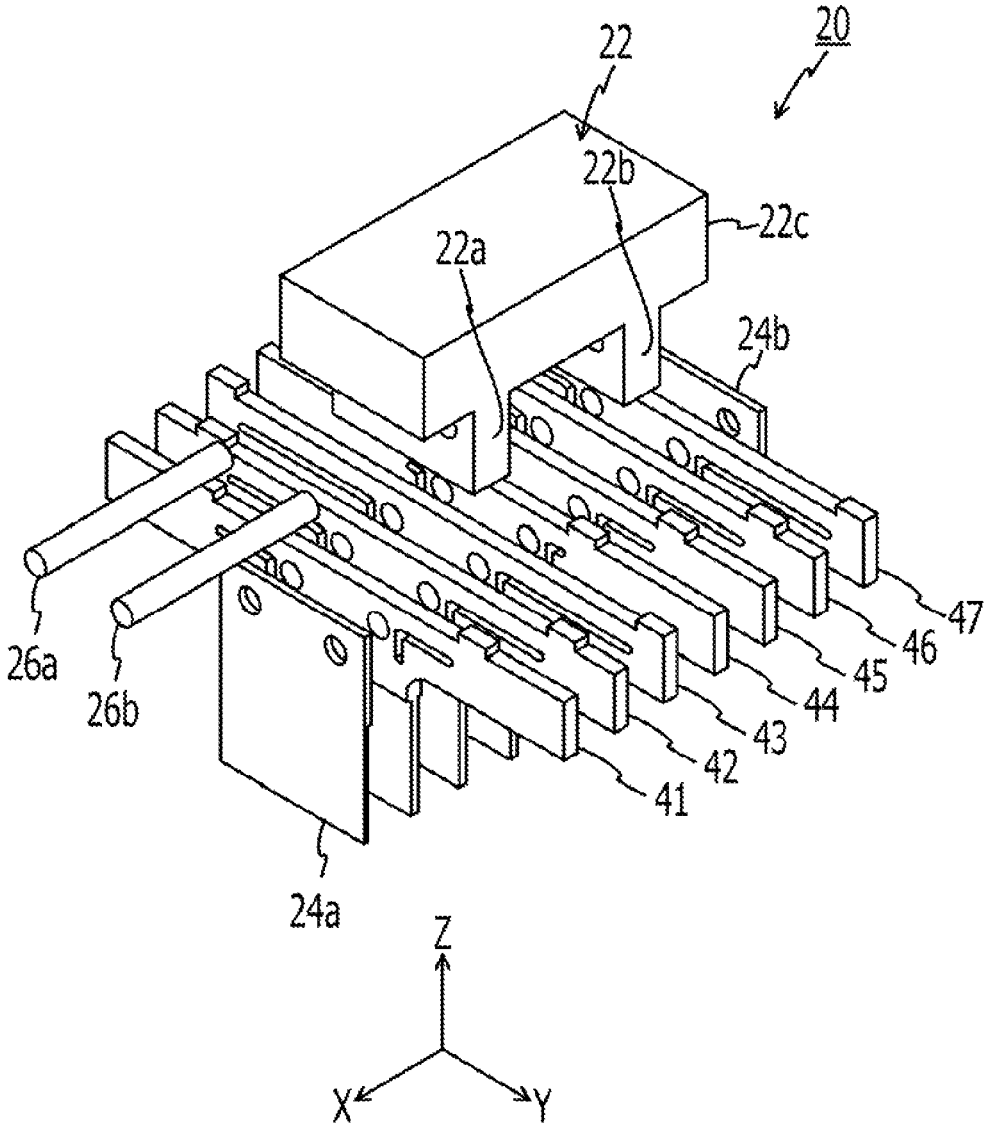
FIG. 5 is an exploded view of a press-fit jig according to the present embodiment.

FIG. 3 shows a specific configuration of the press-fit mechanism 30. Also, FIG. 4 is an exploded perspective view of FIG. 3. FIG. 5 is an exploded perspective view of the press-fit jig 20. As shown in FIG. 3 and FIG. 4, the stress sensors Sa(n) and Sb(n) are fixed to the press-fit jig 20. As shown in FIG. 5, the press-fit jig 20 has a main body part 22, two spacer members 24*a* and 24*b*, seven press members 41 to 47, and holding bars 26*a* and 26*b* for causing the main body part 22 to hold the spacer members 24*a* and 24*b* and the press members 41 to 47.

Figure 6A:
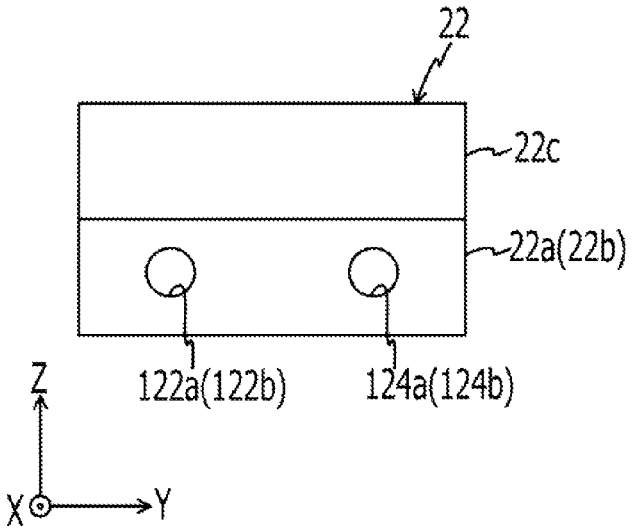
FIG. 6A shows a state of a main body part as seen from a +X direction according to the present embodiment.

According to FIG. 5, the main body part 22 has a block-like section 22*a* having a surface expanding in the XY directions and a pair of convex sections 22*a* and 22*b* protruding from the section 22*a* in the -Z direction and also has essentially a Π-shaped cross section. In the convex sections 22*a* and 22*b* of the main body part 22, as is understood from FIG. 6A showing a state of the main body part 22 as seen from the +X direction, two through holes 122*a* and 124*a* (122*b* and 124*b*) are formed.

Figure 6B:
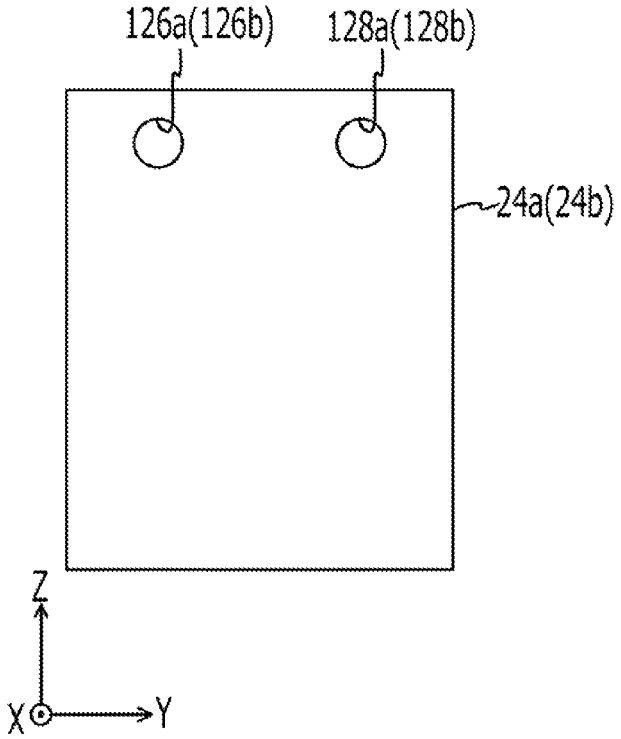
FIG. 6B shows a state of a spacer member as seen from the +X direction according to the present embodiment.

As shown in FIG. 5, the spacer members 24*a* and 24*b* are composed of rectangular plate-like members, and a thickness of a lower section thereof is set to be thinner than other sections. In the vicinity of upper end sections of the spacer members 24*a* and 24*b* (end sections on the +Z side), as is understood from FIG. 6B showing a state of the spacer members 24*a* and 24*b* as seen from the +X direction, two through holes 126*a* and 128*a* (126*b* and 128*b*) are formed. An interval related to the Y-axis direction of the through holes 126*a* and 128*a* (126*b* and 128*b*) is matched with an interval related to the Y-axis direction of the through holes 122*a* and 124*a* (122*b* and 124*b*) formed in the main body part 22.

Figure 7A:
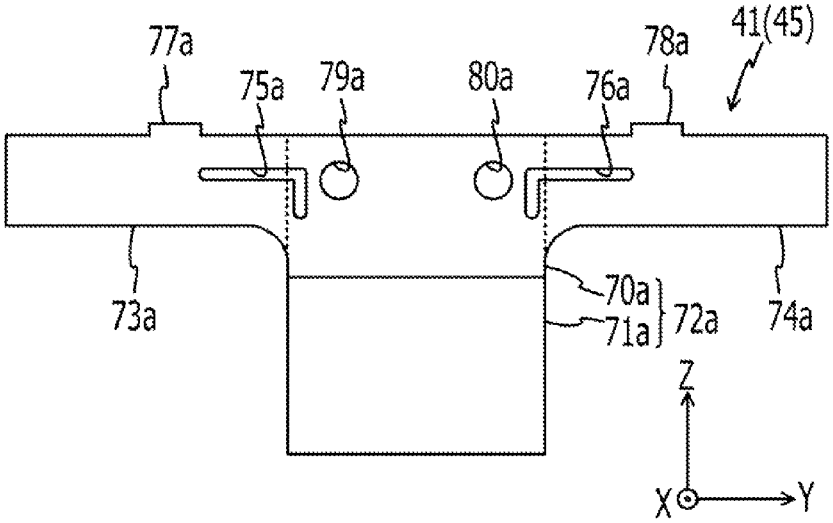
FIG. 7A shows a state of press members as seen from the +X direction according to the present embodiment.

With regard to the press members 41 to 47, as shown in FIG. 5, the press members 41 and 45, the press members 42 and 46, and the press members 43 and 47 respectively have similar shapes. As shown in FIG. 7A, as a whole, the press member 41 is composed of a plate-like member having essentially a T-shape. To be more precise, the press member 41 has a press member 72*a* functioning as a press member main body having essentially a rectangular plate shape located in the center of the Y-axis direction and a pair of arm sections 73*a* and 74*a* extending in one direction intersecting with a longitudinal direction of the press member 72*a* from the press member 72*a* (±Y direction). That is, the press member 72*a* is provided at a location sandwiched by the pair of arm sections 73*a* and 74*a*. It should be noted that in FIG. 7A, border sections between the press member 72*a* and the arm sections 73*a* and 74*a* are indicated by broken lines.

The press member 72*a* has a first section 70*a* to which the arm sections 73*a* and 74*a* are connected and a second section 71*a* located on the -Z side of the first section 70*a* in which a plate thickness is set to be thinner than the first section 70*a*. In the first section 70*a*, a pair of through holes 79*a* and 80*a* penetrating in the X-axis direction are formed. An interval related to the Y-axis direction of the through holes 79*a* and 80*a* is matched with the above-mentioned interval related to the Y-axis direction of the through holes 126*a*, 128*a*, and the like.

A convex section 77*a* is provided on a surface of the arm section 73*a* on the +Z side, and a convex section 78*a* is provided on a surface of the arm section 74*a* on the +Z side. As is understood from FIG. 3 and FIG. 4, the stress sensors Sa(1) and Sb(1) (Sa(5) and Sb(5)) are fixed to the convex sections 77*a* and 78*a*.

Furthermore, the press member 41 has an L-shaped slit 75*a* penetrating in the X-axis direction from the arm section 73*a* to the first section 70*a* of the press member 72*a*. The Y-axis position of the −Y side end section of the slit 75*a* is substantially matched with the Y-axis position of the +Y side end section of the convex section 77*a*. Similarly, the press member 41 has an L-letter shaped slit 76*a* penetrating in the X-axis direction from the arm section 74*a* to the first section 70*a* of the press member 72*a*. The slit 76*a* and the slit 75*a* have bilaterally-symmetric shapes by using the Z axis as a reference. The Y-axis position of the +Y side end section of the slit 76*a* is substantially matched with the Y-axis position of the −Y side end section of the convex section 78*a*.

Figure 7B:
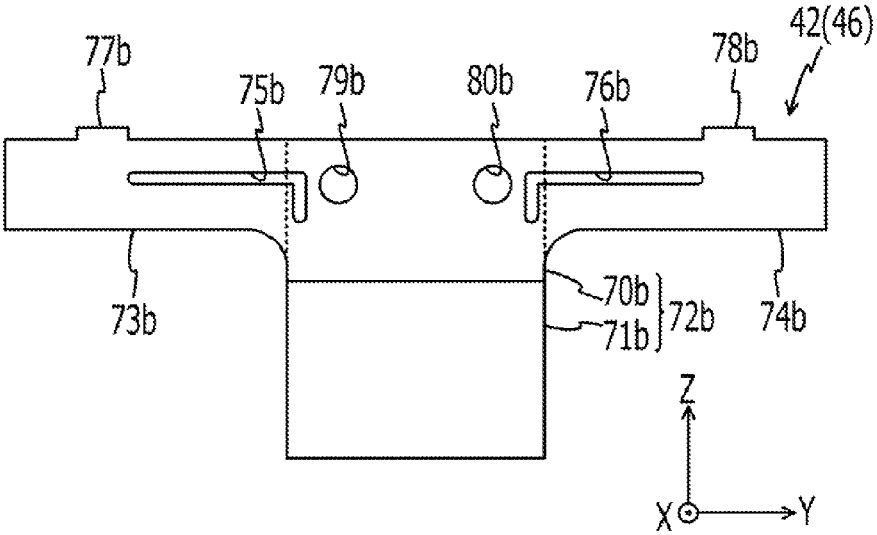
FIG. 7B shows a state of press members as seen from the +X direction according to the present embodiment.

FIG. 7B shows a state of the press member 42 as seen from the +X side. The press member 42 has a configuration similar to the above-mentioned press member 41. It should be noted that in FIG. 7B, configuration parts which are the same or similar to those of the press member 41 are assigned with reference symbols by changing the reference symbols "OOa" of FIG. 7A into OOb. In the press member 42, a convex section 77*b* is arranged on the −Y side with respect to the convex section 77*a*, a convex section 78*b* is arranged on the +Y side with respect to the convex section 78*a*, an end section of a slit 75*b* on the −Y side is arranged on the −Y side with respect to the slit 75*a*, and an end section of a slit 75*b* on the +Y side with respect to the slit 76*a*. The present arrangement of the press member 42 is different from the press member 41.

Figure 8A:
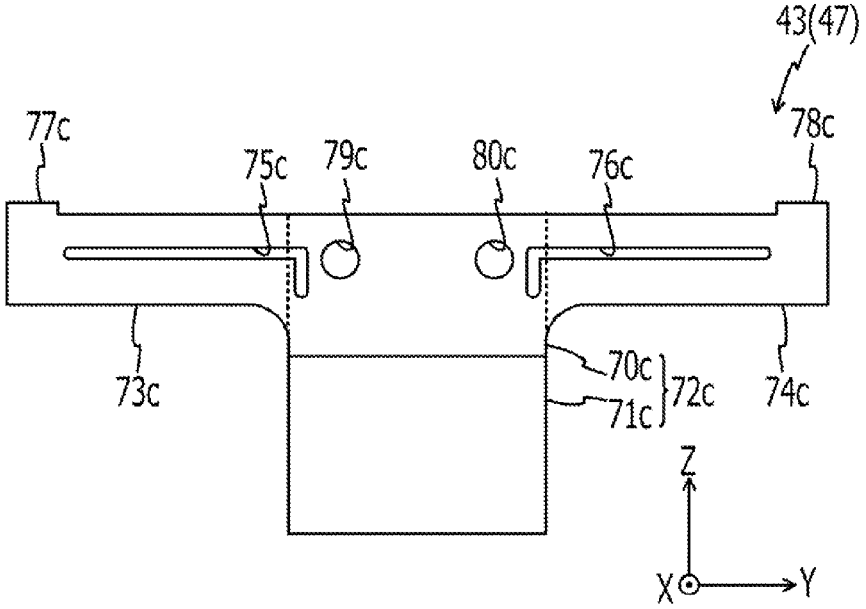
FIG. 8A shows a state of press members as seen from the +X direction according to the present embodiment.

FIG. 8A shows a state of the press member 43 as seen from the +X side. The press member 43 also has a configuration similar to the above-mentioned press members 41, 42, 45, and 46. It should be noted that in FIG. 8A, configuration parts which are the same or similar to those of the press member 41 are assigned with reference symbols by changing the reference symbols "OOa" of FIG. 7A into "OOc".

In the press member 43, a convex section 77*c* is arranged on an end section of the arm section 73*a* on the −Y side, a convex section 78*c* is arranged on an end section of the arm section 74*a* on the +Y side end section, an end section of a slit 75*c* on the −Y side is arranged on the −Y side with respect to the slits 75*a* and 75*b*, and an end section of a slit 76*c* on the +Y side is arranged on the +Y side with respect to the slits 76*a* and 76*b*. The present arrangement of the press member 43 is different from those of the press members 41, 42, 45, and 46.

Figure 8B:
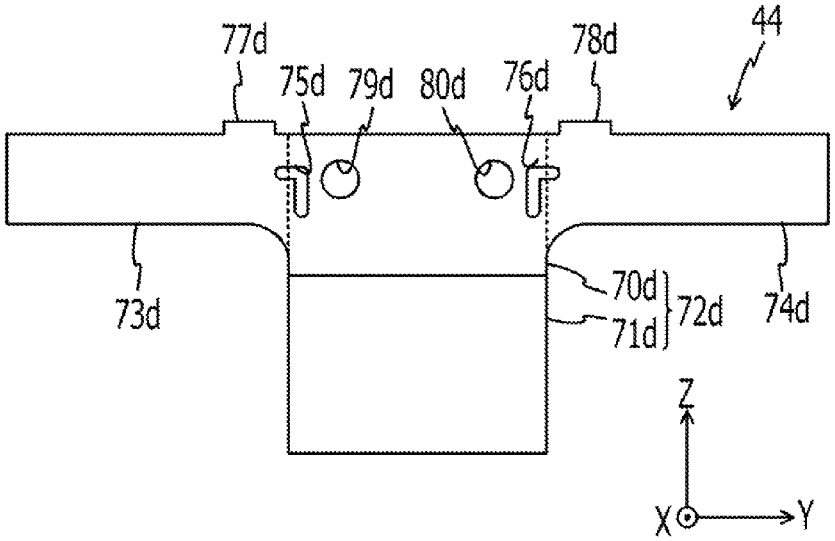
FIG. 8B shows a state of a press member as seen from the +X direction according to the present embodiment.

FIG. 8B shows a state of the press member 44 as seen from +X side. As shown in FIG. 8B, the press member 44 also has a configuration similar to the above-mentioned press members 41 to 43 and 45 to 47. It should be noted that in FIG. 8B, configuration parts which are the same or similar to those of the press member 41 are assigned with reference symbols by changing the reference symbols "OOa" of FIG. 7A into "OOd". In the press member 44, a convex section 77*d* is arranged in the vicinity of the end section of the arm section 73*a* on the +Y side, a convex section 78*d* is arranged on an end section of the arm section 74*a* on the −Y side, an end section of a slit 75*d* on the −Y side is arranged on the +Y side with respect to the other slits 75*a* to 75*c*, and an end section of a slit 76*d* on the +Y side is arranged on the −Y side with respect to the other slits 76*a* to 76*c*. The present arrangement of the press member 44 is different from those of the other press members.

Returning back to the description of FIG. 5, a length of the two holding bars 26*a* and 26*b* is substantially matched with a length (distance) between a surface of the convex section 22*a* on the +X side of the main body part 22 and a surface of the convex section 22*b* on the −X side. It should be noted that the holding bars 26*a* and 26*b* constitute a holding component for holding the press members 41 to 47 together with the main body part 22.

The press-fit jig 20 aligns the press members 41 to 47 and the spacer members 24*a* and 24*b* as shown in FIG. 5. In a state where the press members and the spacer members are located between the convex sections 22*a* and 22*b* of the main body part 22, the press-fit jig 20 sets up while the holding bars 26*a* and 26*b* penetrate the through holes of the respective members. The positions related to the Y-axis direction of the convex sections 77*a* to 77*d* and 78*a* to 78*d* of the press-fit jig 20 are different from each other as shown in FIG. 4. According to this, each of the stress sensors Sa(n) and Sb(n) is not in contact with adjacent other stress sensors. Also, as described above, with regard to the press members 72*a* to 72*d*, the second sections 71*a* to 71*d* are thinner than the first sections 70*a* to 70*d*. In the spacer members 24*a* and 24*b*, a thickness of the lower half is thinner than other sections. Therefore, gaps 49 are formed between the respective members of the press members 72*a* to 72*d* and the spacer members 24*a* and 24*b*.

Returning back to the description of FIG. 2, the stress sensors Sa(n) and Sb(n) are sensors for measuring stresses generated in the press members 41 to 47 of the press-fit jig 20, that is, stresses generated when the contact pins 18 are pressed against the through holes 12*a*. Measurement values by the stress sensors Sa(n) and Sb(n) are sent to the pin bending determination unit 34.

The drive unit 32 is adapted to move the press-fit jig 20 in the Z-axis direction. On the basis of the measurement values sent from the stress sensors Sa(n) and Sb(n), the pin bending determination unit 34 determines whether or not bending is generated in the contact pins 18 of the connector 14. In a case where it is determined that bending occurs, the pin bending determination unit 34 outputs a stop signal to the drive instruction unit 38. It should be noted that details of the determination method of determining whether or not bending has occurred in the contact pins 18 will be described below.

The height position detection unit 36 detects the height position of the press-fit jig 20 (position in the Z-axis direction) and sends the detection result to the drive instruction unit 38. On the basis of the presence or absence of the stop signal from the pin bending determination unit 34 and the measurement value from the height position detection unit 36, the drive instruction unit 38 outputs a drive signal or the stop signal to the drive unit 32. The display unit 39 is connected to the drive instruction unit 38 and performs an error display when the stop signal is output from the pin bending determination unit 34 under an instruction of the drive instruction unit 38.

Figure 9:
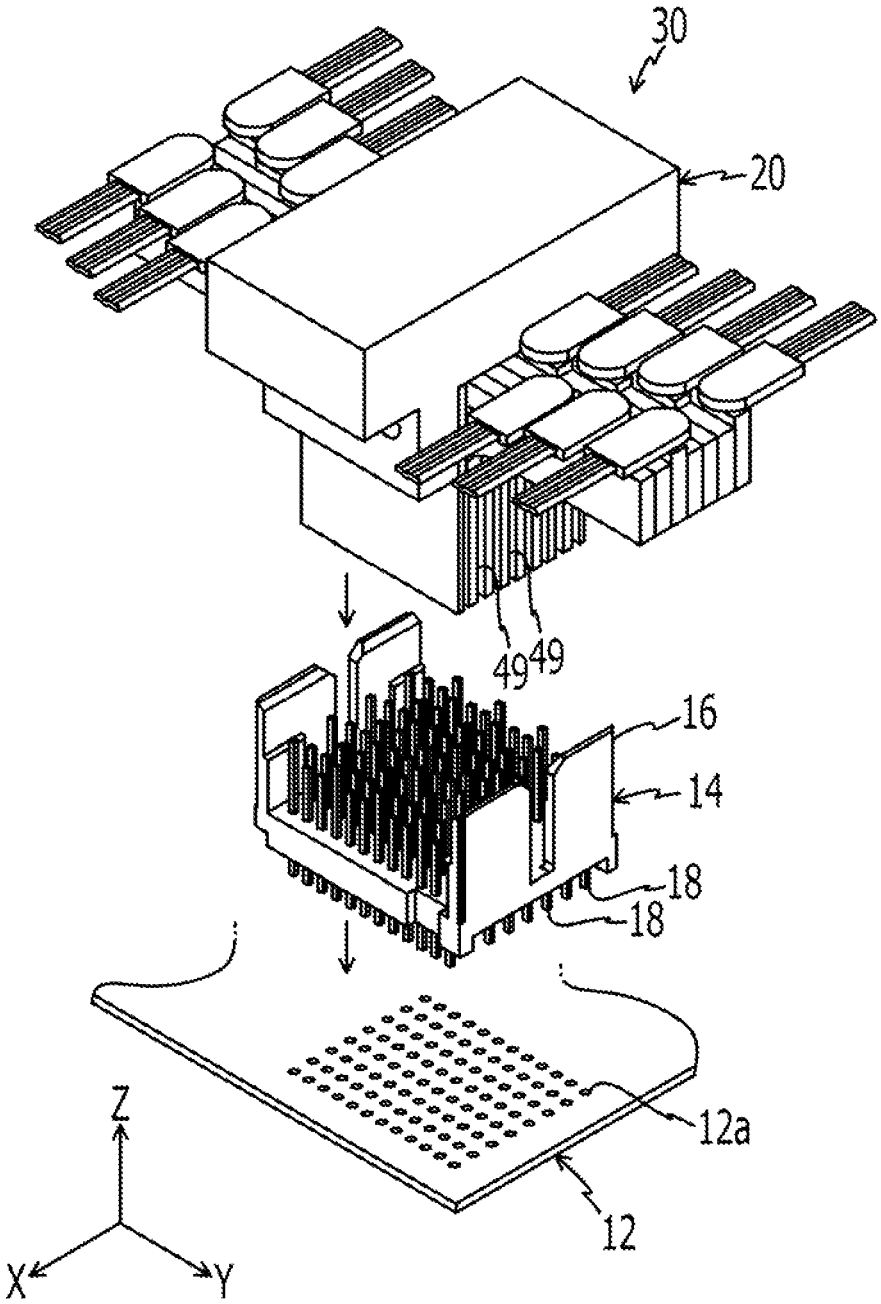
FIG. 9 shows a pressing of the connector by the press-fit mechanism according to the present embodiment.
Figure 10:
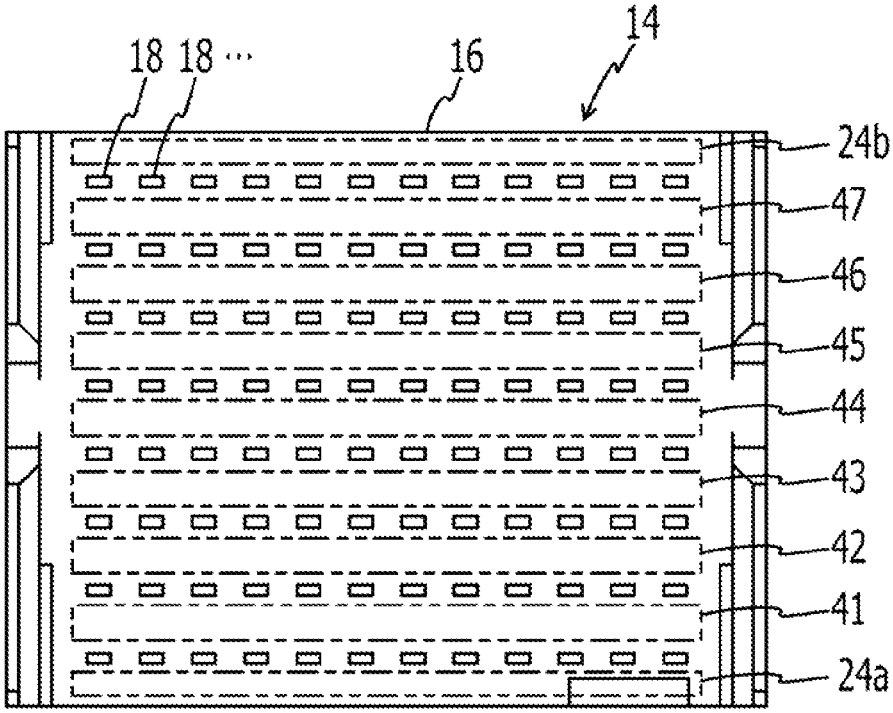
FIG. 10 shows a state of the connector as seen from a +Z direction.

In the thus configured manufacturing apparatus 100, as shown in FIG. 9, in a state where the positions of the through holes 12*a* of the print substrate 12 are matched with the positions of the contact pins 18 of the connector 14, under an instruction of the drive instruction unit 38, the drive unit 32 performs a downward drive on the press-fit mechanism 30. With this downward drive, the press-fit jig 20 of the press-fit mechanism 30 (more precisely, the press members 72*a* to 72*d* of the press members 41 to 47) presses the housing 16 of the connector 14 from the above (+Z direction). FIG. 10 shows a state of the connector 14 as seen from the +Z direction. As shown in FIG. 10, while in contact with the sections indicated by the dashed two-dotted line, the press members 41 to 47 press the housing 16 from above. Herein, as the press-fit jig 20 is provided with the gaps 49, as described above, when the press-fit jig 20 presses the connector 14 from the upper side, the press members 41 to 47 do not mechanically interfere with the contact pins 18. Only the housing 16 is pressed in this manner without pressing the contact pins 18 because the contact pins 18 coming-off from the housing 16 is prevented prior to the press-fit into the through holes 12*a*. It should be noted that as shown in FIG. 1B and the like, the contact pins 18 include pins having different lengths (longer pins) as compared with the other contact pins, and the relevant contact pins may contact the press-fit jig 20 at the time of the above-mentioned press-fit in some cases. Thus, this contact is not designed for the press-fit jig 20 to directly press the contact pins, but is designed to press the contact pins so as not to come off from the housing 16.

As the press is conducted in the above-mentioned manner, the contact pins 18 are press-fitted into the through holes 12*a* for swaging, and the connector 14 is connected to the print substrate 12.

Figure 11:
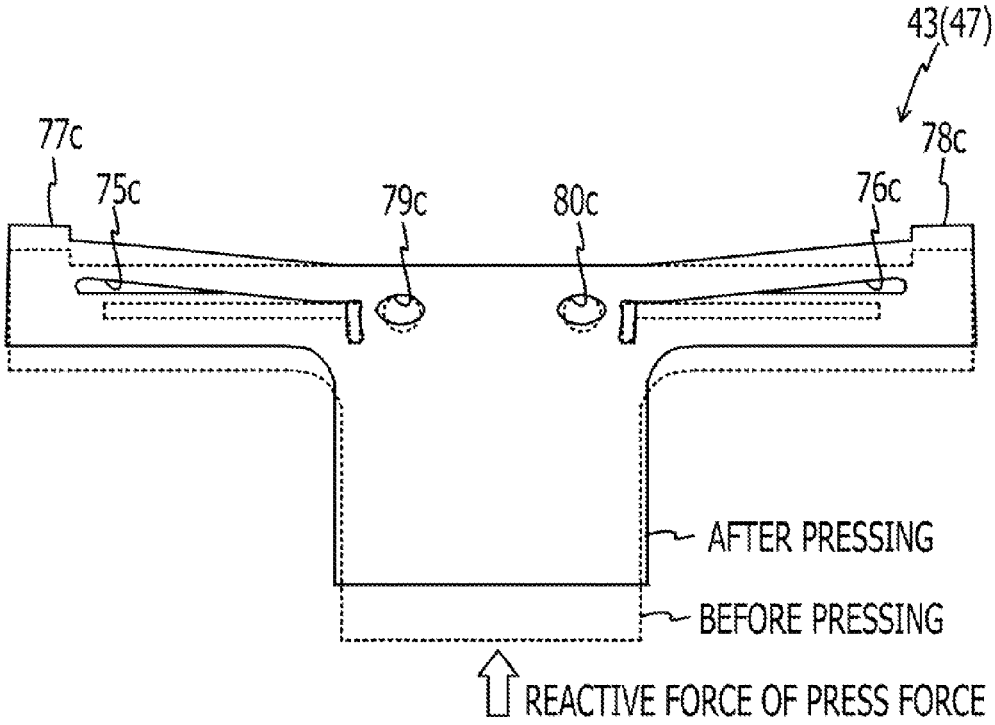
FIG. 11 shows a modification of the press member according to the present embodiment.

Herein, at the time of the above-mentioned pressing, in the press members 41 to 47 of the press-fit jig 20, because of a press force affecting the housing 16, that is, while receiving the reactive force of the press force, stresses are generated inside the respective press members 41 to 47. FIG. 11 schematically shows a deformation state of the press member at the time of the press while the press member 43 is adopted as an example. FIG. 11 shows a state of the press member 43 before the deformation by a broken line and a state of the press member 43 after the deformation by a solid line. As shown in FIG. 11, the stress is generated when the reactive force of the press force affects the lower side of the press member 43, but the stress is amplified because of the deformations of the slits 75*c* and 76*c* to affect the convex sections 77*c* and 78*c*. With the stress sensors Sa(n) and Sb(n), the stresses in the convex sections 77*c* and 78*c* are measured. In the other press members 41, 42, and 44-46 as well, similar stresses are measured. On the basis of the measurement values (Pa(n), Pb(n)), the pin bending determination unit 34 performs the determination of the bending of the contact pins 18.

Figure 12A:
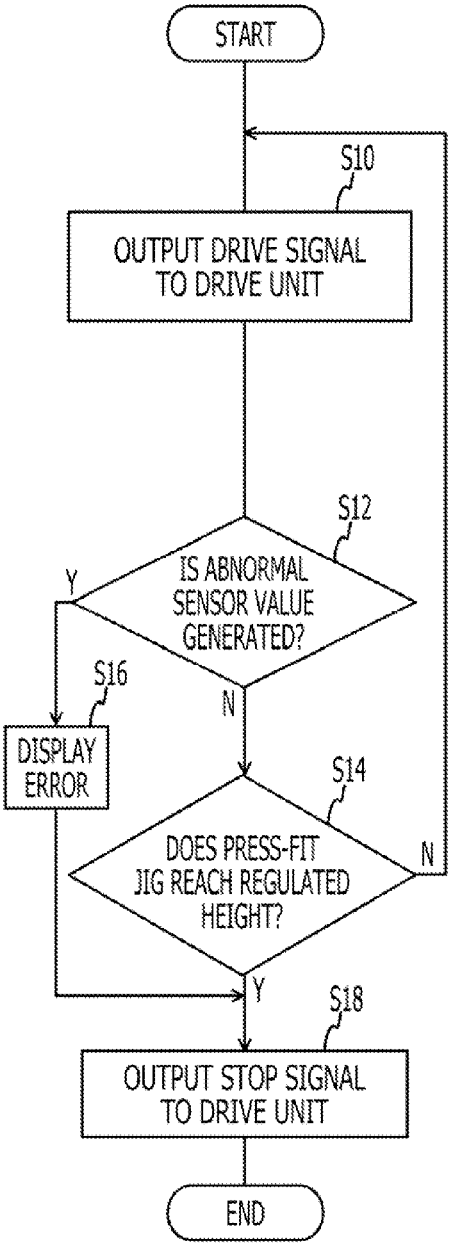
FIG. 12A shows a processing of a drive instruction unit according to the present embodiment.
Figure 12B:
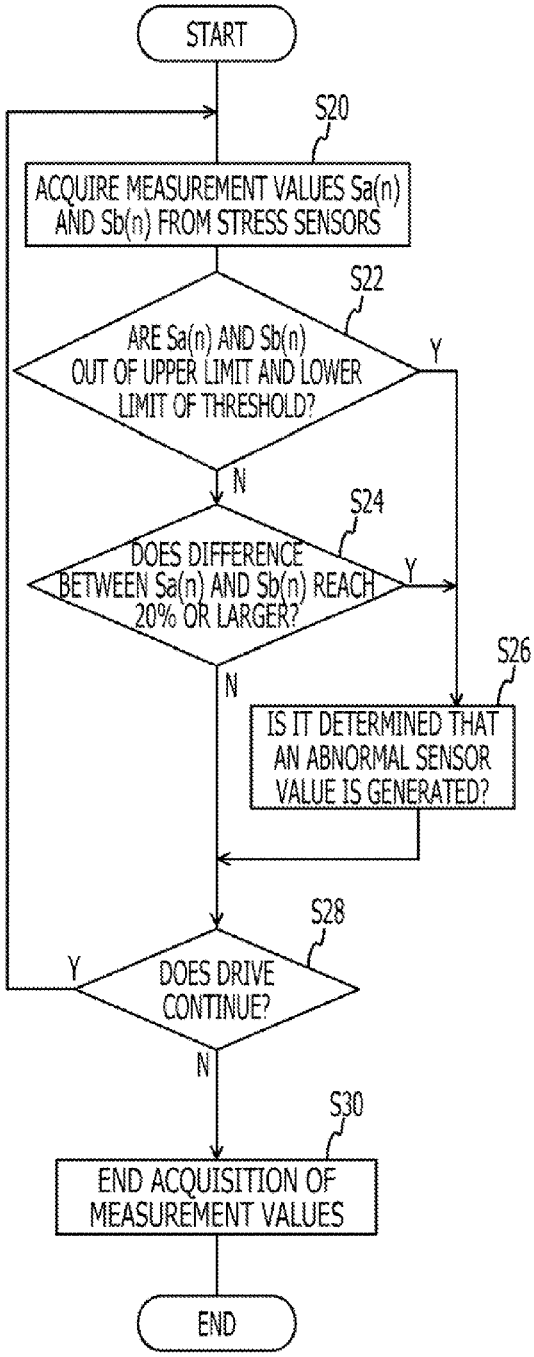
FIG. 12B shows a processing of a pin bending determination unit according to the present embodiment.

Next, a processing by the drive instruction unit 38 and a processing by the pin bending determination unit 34, which are performed when the manufacturing apparatus 100 fixes the connector 14, will be described with reference to flow charts of FIG. 12A and FIG. 12B. The processings of FIG. 12A and FIG. 12B are performed in a simultaneous parallel manner.

First, the flow chart of FIG. 12A will be described. The flow chart of FIG. 12A shows the processing by the drive instruction unit 38. This flow chart starts at a time point when a press start instruction is issued from a user to the drive instruction unit 38 in a state where the connector 14 is arranged on the print substrate 12. First, in step S10, the drive instruction unit 38 outputs a drive signal to the drive unit 32. On the basis of the relevant drive signal, the drive unit 32 lowers the press-fit jig 20 toward the connector 14. Next, in step S12, the drive instruction unit 38 determines whether or not the abnormal sensor value is generated. The generation of the abnormal sensor value means that bending of the contact pins 18 has occurred, the details of which will be described below. In a case where the determination is negative, in step S16, the drive instruction unit 38 performs the error display on the display unit 39, and thereafter, the stop signal is output to the drive unit 32 in step S18. According to this, the downward drive of the press-fit jig 20 by the drive unit 32 stops. In this case, while following the error display, the user can remove the connector 14 from the top of the print substrate 12 and arrange another connector on the print substrate 12 to perform the press-fitting again.

On the other hand, in a case where the abnormal sensor value is not generated and the determination in step S12 is negative, the flow is shifted to step S14. In step S14, the drive instruction unit 38 determines whether or not the press-fit jig 20 reaches a regulation height on the basis of the measurement value of the height position detection unit 36. The "regulation height" in this case means a height where the press-fit jig 20 is located when the press-fit jig 20 presses the connector 14 to complete the press-fit. When the determination at this time is negative, the flow is returned to step S10, and the drive instruction unit 38 continues the output of the drive signal to the drive unit 32. On the other hand, when the determination in step S14 is affirmative, this situation means that the press-fit of the connector 14 is completed. Thus, in step S18, the drive instruction unit 38 outputs the stop signal to the drive unit 32 to end all the processes in the flow chart of FIG. 12A.

Figure 13:
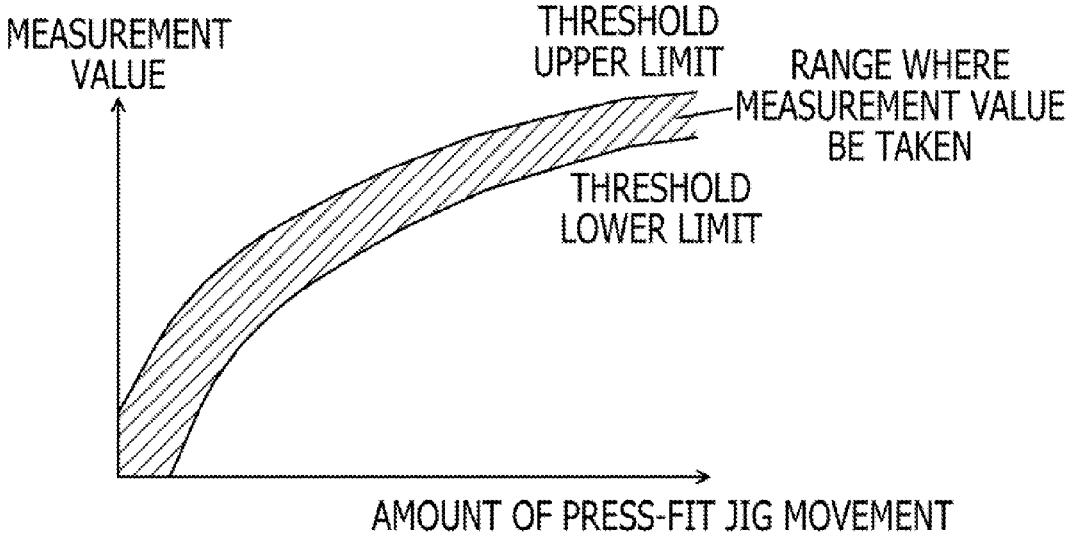
FIG. 13 shows a map regulating a threshold upper limit and a threshold lower limit.
Figure 14:
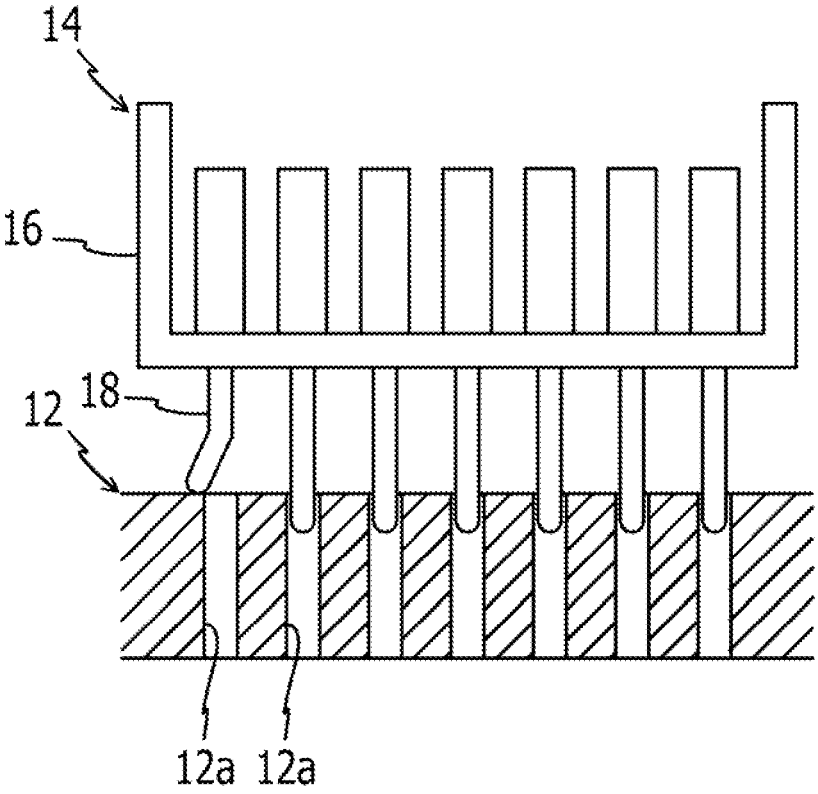
FIG. 14 shows a state in which bending is generated in a contact pin.
Figure 15A:
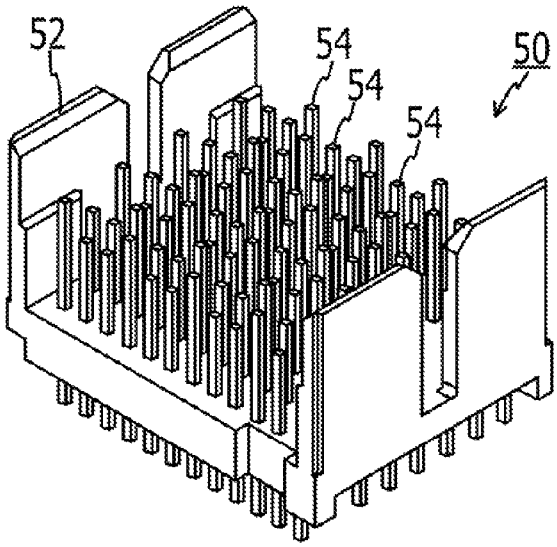
FIG. 15A PRIOR ART
FIG. 15A shows a connector in related art.
Figure 15B:
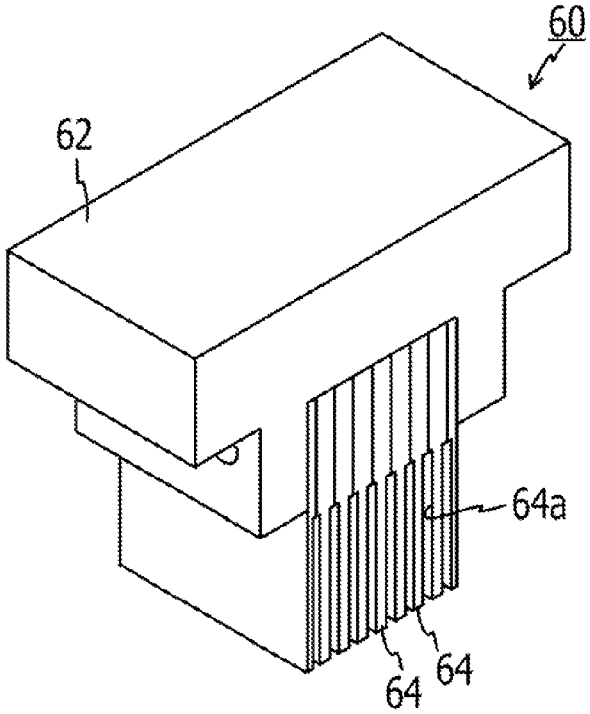
FIG. 15B PRIOR ART
FIG. 15B shows a press-fit member in related art.

Next, the flow chart of FIG. 12B will be described. The flow chart of FIG. 12B shows the processing by the pin bending determination unit 34. This flow chart is also started at a time point when the user issues the instruction of the press start to the drive instruction unit 38. First, in step S20, the pin bending determination unit 34 obtains the measurement values Pa(n) and Pb(n) by the stress sensors Sa(n) and Sb(n). Next, in step S22, the pin bending determination unit 34 determines whether or not the respective measurement values Pa(n) and Pb(n) are out of a range between a threshold upper limit and a threshold lower limit. At this time, the pin bending determination unit 34 performs the determination in step S22 by using a map regulating the threshold upper limit and the threshold lower limit. FIG. 13 shows the map regulating the threshold upper limit and the threshold lower limit of the measurement value of the stress sensor corresponding to the amount of movement of the press-fit jig 20. In FIG. 13, when the measurement value is in a range indicated with hatching, bending has not occurred in the contact pins 18, which means that the press-fit is normally conducted. Therefore, in step S22 of FIG. 12B, while the value of the height position detection unit 36 is monitored, it is determined as to whether or not the respective measurement values Pa(n) and Pb(n) are out of the range between the threshold upper limit and the threshold lower limit. According to this, it is determined as to whether or not the bending shown in FIG. 14 has occurred in the contact pins 18.

As described above, the stress sensors Sa(n) and Sb(n) are arranged at various positions of the arm sections of the press members 41 to 47. Therefore, the threshold upper limit and the threshold lower limit vary depending on the respective stress sensors. For this reason, in the pin bending determination unit 34, it is necessary to store a map regulating different threshold upper limits and threshold lower limits for the respective stress sensors.

Incidentally, according to the present embodiment, as the stress sensors are provided in the respective press members, it is possible to determine the presence or absence of bending in the contact pins 18 at a high level of precision. To be more specific, when it is assumed that the number of the contact pins 18 is 98, for example, 2 kgf is required per contact pin for press-fitting the contact pins 18. Also, it is assumed that 1 kgf is the force required for one contact pin 18 to be buckle. That is, when all the contact pins 18 can be normally press-fitted, a force of 196 kgf is applied to the contact pins 18, and when bending is generated in one contact pin, a force of 195 kgf is applied to the contact pins 18. In this case, if only one pair of the stress sensors is provided to the press-fit jig 20, for example, it is necessary to detect a case where the press-fit is normally conducted (196 kgf) and a case where bending is generated in one contact pin (195 kgf) by using one pair of the stress sensors. Thus, this difference of 1 kgf ((196−195) kgf) may be mistakenly hidden and may not be detected in some cases. In contrast to this, according to the present embodiment, each of the press members 41 to 47 is provided with the stress sensors Sa(n) and Sb(n), and therefore each pair of the sensors may only handle 28 kgf which is 1/7 of 196 kgf. In this case, each pair of the sensors may detect a case where the press-fit is normally conducted (28 kgf) and a case where bending is generated in one contact pin (27 kgf). Thus, it is possible to determine the presence or absence of bending in the contact pins at a satisfactory level of precision.

Through the above-mentioned determination, in a case where the determination in step S22 is affirmative, the flow is shifted to step S26. The pin bending determination unit 34 determines that the abnormal sensor value is generated, and the flow is shifted to step S28. On the other hand, in a case where the determination in step S22 is negative, the flow is shifted to step S24, and by comparing the measurement value Pa(n) with the measurement value Pb(n), it is determined as to whether or not the difference between Pa(n) and Pb(n) is equal to or larger than 20% of the value of Pa(n). In a case where the determination at this time is negative, the flow is shifted to step S28, but in a case where the determination at this time is affirmative, the flow passes through step S26 and is shifted to step S28. It should be noted that in step S24, it is determined whether or not a balance between the measurement values Pa(n) and Pb(n) is lost at least to a certain extent. In this way, a case where the balance between the measurement values Pa(n) and Pb(n) is lost at least to the certain extent also means a high probability that bending of the contact pins 20 is occurring. Therefore, when the determination in step S24 is also affirmative, similar to in step S22, the flow is shifted to step S26.

In step S28, it is determined as to whether or not driving of the drive unit 32 is continued. When the determination at this time is negative means the processing in step S18 in the flow chart of FIG. 12A is already being conducted. When the determination at this time is affirmative, the flow returns to step S20. On the other hand, when the determination at this time is negative, in step S30, the acquisition of the measurement values Pa(n) and Pb(n) from the stress sensors Sa(n) and Sb(n) is ended, and all processes in FIG. 12B are ended.

In a case where the processing in FIG. 12B passes through step S26, the abnormal sensor value is generated. Thus, when the determination in S12 in the flow chart of FIG. 12A is thereafter conducted, the determination is set to be affirmative.

In the above, as described in detail, according to the present embodiment, as the plurality of press members 41 to 47 in contact with the housing 16 of the connector 14 are pressed by the drive unit 32, the plurality of contact pins 18 held by the housing 16 are pressed toward the through holes 12*a* of the print substrate 12. Then, among the press members 41 to 47, the stress sensors Sa(n) and Sb(n), provided to one pair of the arm sections extending in one direction intersecting with the pressing direction, measure the stresses generated when the contact pins 18 are pressed against the print substrate 12. Therefore, even when bending is generated in any of the contact pins 18, by using the measurement results of the stress sensors Sa(n) and Sb(n) provided to the respective arm sections, it is possible to determine the presence or absence of bending at a high level of precision. According to this, when the contact pins 18 are press-fit into the through holes 12*a*, that is, when the connector 14 is mounted, it is possible to determine the presence or absence of bending in the contact pins 18 at a high level of precision. Therefore, even when bending is generated, it is possible to detect the mounting failure before the completion of the press-fitting of the contact pins 18. Thus, the drive instruction unit 38 controls the press force on the basis of the detection results of the stress sensors, so that the press-fitting can be cancelled in mid-course. For this reason, it is possible to substantially reduce the time and man-hours used for removal operations for mounting failure connectors (in particular, the operation for pulling out the contact pins 18 one by one), and also the connector 14 can be mounted to the print substrate 12 accurately. Also, according to the present embodiment, even in a case where the connectors are mounted to both sides of the print substrate 12, it is possible to detect bending in the contact pins 18 during the mounting. Furthermore, according to the present embodiment, as the stress sensors Sa(n) and Sb(n) are directly provided to the press-fit jig 20, the space efficiency is satisfactory as compared with a case where bending in the contact pins is detected by using a separate camera or the like.

Also, Japanese Laid-open Patent Publication No. 6-283898 also discloses a method of detecting a height of a press-fit head (equivalent to the press-fit jig 20 according to the present embodiment) and determining that the pin bending is generated in a case where the height is not a predetermined height. However, according to this method, because of an influence of a fluctuation in through hole diameters and pin dimensions and a fluctuation in housing dimensions, the pin bending may not accurately be determined in some cases. Also, in the connector according to the present embodiment, the pin where the bending occurs is subjected to buckling by the press force. Therefore, according to the method in the above-mentioned patent publication, it is highly likely that the presence or absence of the pin bending cannot be determined. In contrast to this, by using the press-fit mechanism 30 according to the present embodiment, it is possible to determine pin bending at a satisfactory level of precision.

Also, according to the present embodiment, in the press members 41 to 47, the slits 75*a* to 75*d* and 76*a* to 76*d* are formed while penetrating between sections of the press members 72*a* to 72*d* and sections where the stress sensors Sa(n) and Sb(n) of the arm sections 73*a* to 73*d*, and 74*a* to 74*d* are provided. Therefore, the force affecting the press members 72*a* to 72*d* can be amplified by the slits 75*a* to 75*d* and 76*a* to 76*d*, and the amplified force (stress) can be measured by the stress sensors Sa(n) and Sb(n). According to this, it is possible to detect bending in the contact pins 18 at a high level of precision.

Also, according to the present embodiment, the pin bending determination unit 34 compares the measurement results by the stress sensors Sa(n) and Sb(n) with the previously determined threshold (FIG. 13) to determine whether or not the contact pins 18 are being properly inserted through the through holes 12*a*. Thus, it is possible to easily detect bending in the contact pins 18.

Also, according to the present embodiment, in addition, the pin bending determination unit 34 determines whether or not the contact pins 18 are normally press-fit into the through holes 12*a* on the basis of the difference between the respective measurement results. Thus, it is possible to detect bending in the contact pins 18 at a more satisfactory level of precision.

It should be noted that according to the above-mentioned embodiment, the description has been given of the case where the slits are formed while penetrating the press members 41 to 47, but the embodiment is not limited to this, and the slits may not be necessarily formed. Also, even in a case where the slits are provided, any shape can be adopted as long as the stress is amplified.

It should be noted that according to the above-mentioned embodiment, the description has been given of the case where the pin bending determination unit 34 determines that the abnormal sensor value is generated when either of the determinations in step S22 or S24 is affirmative, but the embodiment is not limited to this. For example, one of the determinations in step S22 or S24 may not be performed.

Also, according to the above-mentioned embodiment, in step S16 of FIG. 12A, the description has been given of the case where the user removes the connector 14 from the top of the print substrate 12 and also arranges another connector, but the embodiment is not limited to this. For example, the removal of the connector where the bending in the contact pins occurs and the rearrangement of the other connector may be performed in a full automatic manner by using a robot or the like.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present inventions have been described in detail, it should be understood that various changes, substitutions, and alterations could be made hereto without departing from the spirit and scope of the invention.

The invention claimed is:

1. A manufacturing apparatus for an electronic component, the manufacturing apparatus comprising:

a plurality of press members provided with a pair of arm sections extending in one direction intersecting with a direction of the pressing, the plurality of press members contacting a housing of a connector and pressing a plurality of pins held by the housing toward a plurality of holes in a substrate;

a drive unit pressing the press members and press-fitting the plurality of pins into the holes in the substrate;

a stress measurement unit coupled with the pair of arm sections and adapted to measure a stress generated at the pair of arm sections when the pins are pressed toward the holes in the substrate; and a drive control unit controlling a press force of the drive unit in accordance with a measurement result of the stress measurement unit.

2. The manufacturing apparatus for the electronic component according to claim 1, wherein each of the plurality of press members has a press member main body provided at a location sandwiched by the pair of arm sections and has a slit-like penetrating holes formed from a part of the press member main body to the stress measurement unit of the arm section.

3. The manufacturing apparatus for the electronic component according to claim 1, wherein the drive control unit determines whether or not the pins are normally press-fitted into the holes on the basis of a measurement result by the stress measurement unit.

4. The manufacturing apparatus for the electronic component according to claim 3, wherein the drive control unit determines whether or not the pins are normally press-fitted into the holes by comparing the measurement result by the stress measurement unit with a previously determined threshold.

5. The manufacturing apparatus for the electronic component according to claim 3, wherein the drive control unit determines whether or not the pins are normally press-fitted into the holes on the basis of a difference among measurement results of the stress measurement unit corresponding to each arm of the pair of arm sections.

* * * * *